United States Patent [19]

Miyagi et al.

[11] Patent Number: 4,618,382

[45] Date of Patent: Oct. 21, 1986

[54] SUPERPLASTIC ALUMINIUM ALLOY SHEETS

[75] Inventors: Yoshimitsu Miyagi, Ohyadaimachi; Mitsuo Hino, Tochigi; Takehiko Eto, Ohyadaimachi, all of Japan

[73] Assignee: Kabushiki Kaisha Kobe Seiko Sho, Kobe, Japan

[21] Appl. No.: 660,126

[22] Filed: Oct. 12, 1984

[30] Foreign Application Priority Data

Oct. 17, 1983 [JP] Japan ..... 58-193598
Oct. 17, 1983 [JP] Japan ..... 58-193599

[51] Int. Cl.[4] ..... C22C 21/00

[52] U.S. Cl. ..... 148/415; 148/12.7 A; 148/416; 148/417; 148/418; 420/902

[58] Field of Search ..... 148/11.5 A, 12.7 A, 148/415, 416, 417, 418, 437, 438, 439, 440; 420/902

[56] References Cited

U.S. PATENT DOCUMENTS 4,486,244 12/1984 Ward et al. ..... 148/12.7 A

*Primary Examiner*—R. Dean

*Attorney, Agent, or Firm*—Oblon, Fisher, Spivak, McClelland & Maier

[57] ABSTRACT

Sheets of high strength superplastic Al—Zn—Mg alloys or Al—Cu alloys which having a maximum grain size below 30 μm on average are described. These alloy sheets are obtained by a method which is characterized by keeping a homogenized and hot worked ingot of the alloy at two different temperatures for sufficient times whereby a fine grain structure is formed in the alloy to impart superplasticity to the alloy.

15 Claims, No Drawings

SUPERPLASTIC ALUMINIUM ALLOY SHEETS

BACKGROUND OF THE INVENTION

1. Field of the Invention

This invention relates to the art of aluminium alloys and more particularly, to the production of superplastic high strength Al—Zn—Mg or Al—Cu alloy sheets.

2. Description of the Prior Art

By the term "superplasticity" is meant a phenomenon where a material is able to be elongated to an extent of several hundreds to one thousand percent under certain external conditions without necking of the material. The superplasticity may be broadly divided into two categories including transformational superplasticity utilizing phase transformation by thermal cycling and fine grain superplasticity (structural superplasticity) which will be observed in fine grain crystal materials. In order to cause the fine grain superplasticity, it is essential that the crystal grain size of material be controlled to be fine.

In general, high strength aluminium alloys are produced by a sequence of steps including homogenizing a cast ingot at a temperature of 400° to 550° C., subjecting the homogenized ingot to hot and cold workings at a temperature of 350° to 550° C., followed by subjecting to solution treatment at a temperature of 450° to 550° C. and aging. The alloys obtained by the above ordinary steps have a grain size as large as 40 to 100 μm. Even when the alloys are deformed at high temperatures, superplasticity cannot be obtained.

In order to obtain high strength Al—Zn—Mg or Al—Cu alloys, several methods have been heretofore proposed, typical of which is described in U.S. Pat. No. 4,358,324. In the thermomechanical processing method, high strength aluminium alloys such as 7475, 2219 and the like are treated by dissolving some of precipitating constituents in the alloy by heating the alloy to a solid solution temperature, overaging and recrystallizing the alloy by warm working and quick heating. The warm working must be effected at a high rolling reduction and cannot thus be applied to thick sheets. Additionally, when intermetallic compounds of solute elements precipitate in excess due to the overaging treatment, little effects of fine graining are produced.

SUMMARY OF THE INVENTION

It is accordingly an object of the present invention to provide sheets of superplastic aluminium alloys having a finer grain structure than attained by the known thermomechanical processing method using high strength aluminium alloys.

It is another object of the invention to provide sheets of superplastic aluminium alloys which are more readily obtained than the alloys produced by the known method.

The present invention is characterized by specific thermomechanical processing steps of Al—Zn—Mg alloys or Al—Cu alloys, both comprising at least one solute metal element and at least one transition metal element in which, after thermomechanical processing, homogenization and hot working, an alloy selected from the above-specified alloys is kept at a first temperature higher than a solution temperature of the solute metal element and cooled to a predetermined temperature, and subsequently kept at a second temperature at which intermetallic compounds of the transition element with aluminium having a fine grain structure are permitted to uniformly precipitate and cooled at a predetermined cooling rate.

More particularly, there is provided according to the present invention a sheet of a superplastic aluminium alloy selected from the group consisting of Al—Zn—Mg alloys and Al—Cu alloys and having a maximum grain size below 30 μm on average which are obtained by a method which comprises the steps of:

(1) homogenizing a high strength aluminium alloy ingot comprising at least one solute element and at least one transition element under heating conditions;

(2) subjecting the alloy ingot to hot working to form an alloy plate;

(3) heating the alloy plate to a first temperature higher than a solution temperature of the at least one solute element and keeping it at the first temperature;

(4) cooling the alloy plate to a temperature at which the at least one solute metal element is precipitated and then keeping the alloy plate at the precipitating temperature for a time sufficient to cause fine intermetallic compounds of the at least one transition element and aluminium to precipitate uniformly;

(5) cooling the alloy plate at such a rate of cooling that the intermetallic compounds of the at least one solute element are prevented from precipitating in the form of coarse precipitates; and (6) subjecting the cooled alloy plate to cold working.

The resulting alloy sheet may be further softened with or without further cold working. The aluminium alloys useful in the present invention include Al—Zn—Mg alloys and Al—Cu alloys. The Al—Zn—Mg alloys should preferably have the following composition which comprises 3 to 8 wt% of Zn, 0.5 to 3 wt% of Mg, at least one member selected from the group consisting of below 3 wt% of Cu, 0.05 to 2.0 wt% of Mn, 0.05 to 2.0 wt% of Cr, 0.05 to 0.5 wt% of Zr, 0.05 to 0.5 wt% of V and below 0.15 wt% of Ti, and the balance of Al and inevitable impurities. In the above alloy composition, at least one transition element should be contained: if Cu is selected as at least one member, at least one other element selected from the transition elements should be contained. On the other hand, the Al—Cu alloys should preferably have the following composition which comprises 2 to 7 wt% of Cu, at least one member selected from the group consisting of below 2.5 wt% of Mg, below 2 wt% of Si, 0.05 to 05 wt% of Mn, 0.05 to 2.0 wt% of Cr, 0.05 to 0.5 wt% of Zr, 0.05 to 0.5 wt% of V and below 0.15 wt% of Ti, and the balance of Al and inevitable impurities. In this case, at least one transition element should be selected as incorporated in the Al—Cu alloy.

DETAILED DESCRIPTION AND PREFERRED EMBODIMENTS OF THE INVENTION

Preparation of the superplastic aluminium alloy sheets according to the present invention is described.

The aluminium alloys having, for example, such a composition as defined before are cast to obtain ingots. The thus obtained ingot is first thermally treated so that the metal elements inhomogeneously distributed therein are homogenized to improve hot workability of the ingot. For the homogenizing procedure, it is preferable to heat the ingot at a temperature of from 400° to 550° C. for a time sufficient for the homogenization. Subsequently, the ingot is hot worked to give a plate of a predetermined thickness. The hot working is usually effected at a temperature between 350° and 500° C.

During the hot working, the coarse structure of the ingot is converted into a hot fiber structure and, at the same time, precipitates of Zn, Mg, Cu and the like are formed in the structure along with partial precipitation of part of transition elements such as Mn, Cr, Zr, V and/or Ti. It is preferred that after the hot working, the alloy is subjected to cold working to a level over 30%, by which finer crystal grains are obtained, enabling the alloy to be imparted with great superplastic elongation.

The hot worked alloy is then maintained at a first temperature of, for example, 450° to 550° C. for a time sufficient to solubilize most of the solute elements precipitated during the course where the alloy is kept at the above temperature.

Thereafter, the allow is cooled to a second temperature where it is maintained at a second temperature of 350° to 450° C. for a time of 0.5 to 50 hours, followed by cooling at a predetermined rate. The cooling rate is preferably over 30° C./hr. Higher second temperatures will allow a shorter heating time.

During the course where the alloy is kept at the second temperature, the transition elements such as Mn, Cr, Zr and the like react with aluminium to precipitate intermetallic compounds such as $MnAl_6$, $Cr_2Mg_3Al_{18}$, $ZrAl_3$ and the like. The resulting fine grain structure produced in the alloy is kept as it is by heating in a superplastic temperature region after the cold working and the alloy is thus imparted with superplasticity.

When comparing the two-stage temperature maintenance with a one-stage temperature maintenance, a finer crystal grain of the transition elements is formed with a slight amount of precipitates between Zn, Mg, Cu and the like and Al formed by aging at high temperatures. Accordingly, the cooling rate after the maintenance at high temperatures may be as slow as 30° C./hour. This brings about the advantages that preparation of the alloy becomes easy, the density of dislocation of metal elements produced during the cold rolling procedure becomes high and fine crystal grains are produced with a great degree of superplastic elongation. The substructure of dislocation forming the hot fiber structure by the temperature maintenance is restored and recrystallized, so that strain energy is reduced. The following cold working allows easy dislocation.

The cooling rate after the second temperature maintenance less than 30° C./hour is disadvantageous because it is difficult to attain superplastic elongation.

After cooling, the cold working over 30% should preferably be carried out. In view of the grain size, a processing rate below 30% is unsatisfactory.

In the production of the superplastic aluminium alloys according to the invention, the alloys which have been cold-worked may be subjected directly to superplastic processing. Alternatively, the cold-worked alloy may be heated at a heating rate of 100° C./hour and then thermally softened at a temperature of 350° to 550° C.

Still alternatively, the alloy may be cold-worked at a rate of 20 to 60%, and then softened at low temperatures below 300° C. and again cold worked. By the low temperature annealing procedure, the crystal grains may become finer.

The thus cold-worked alloys have a dense substructure of dislocation having high strain energy. It is general that when the alloys are heated to a superplastic temperature region over 0.5 Tm in which Tm represents a melting point (absolute temperature) of the alloy, e.g. over 400° C. with aluminium alloys, new crystal grains are formed about the high density dislocation structure. This means that a higher density of the dislocation structure results in a finer grain structure, leading to a higher superplastic elongation. Once the recrystallization is completed, energy of the crystal grain boundary is reduced, so that the dislocation is moved with the tendency that the crystal grains are made coarse. The coarse crystal grains will impede superplastic deformation.

In the production of the superplastic aluminium alloys according to the invention, the precipitates such as $MnAl_6$, $Cr_2Mg_3Al_{18}$, $ZrAl_3$ and the like formed during the maintenance at high temperatures after the hot working are controlled with respect to the size and its distribution, thus preventing the movement of the dislocation and keeping the fine grain structure. If the size of the precipitates is too small or the interparticular space is too large, the effect of preventing the movement of the dislocation is not obtained.

The superplastic alloys of the invention having a five crystal grain structure obtained by the procedure described above exhibit a superplastic elongation as high as 300–500% or more, without involving any necking phenomenon, when deformed at certain temperatures, e.g. over 400°.

The constituents of the aluminium alloys and ratios of these constituents are described.

First, reference is made to the Al—Zn—Mg alloys.

In the alloys, if the content of Zn is less than 3 wt%, satisfactory strength cannot be obtained. On the contrary, when the content exceeds 8 wt%, ductility and corrosion resistance are lost. Accordingly, the content of Zn is from 3 to 8 wt%.

With Mg, satisfactory strength cannot be obtained when its content is less than 0.5 wt%, whereas the content exceeds 3 wt%, cold processability is impeded. Thus, the content of Mg is from 0.5 to 3 wt%.

Cu, Mn, Cr, Zr, V and Ti are not essential constituents but at least one transition element other than Cu should be contained in the alloys of the invention. If contained, these elements are used in amounts defined below.

When the content of Cu exceeds 3 wt%, ductility and toughness are lost and thus the content is below 3 wt%.

When at least one of Mn, Cr, Zr and V is contained in amounts less than 0.05 wt%, fine crystal grains cannot be obtained for the reason described hereinbefore. When the content of Mn exceeds 2.0 wt%, the contents of Cr, Zr and V are, respectively, over 0.5 wt%, and the content of Ti exceeds 0.15 wt%, they do not sufficiently dissolved upon casting, so that gigantic intermetallic compounds are produced with satisfactory elongation being not attained. Accordingly, the content of Mn is from 0.05 to 2.0 wt%, the contents of Cr, Zr and V are, respectively, from 0.05 to 0.5 wt%, and the content of Ti is below 0.15 wt% if they are contained in the alloys.

It should be noted that if Fe and Si which may be contained as impurities are over 0.15 wt%, insoluble crystals are formed with a considerable lowering of elongation. Accordingly, the contents of Fe and Si should be below 0.15 wt%.

The Al—Cu aluminium alloys are described.

Satisfactory strength cannot be obtained in a content of Cu less than 2 wt%. However, when the content exceeds 7 wt%, a lowering of elongation becomes considerable. The content of Cu is thus from 2 to 7 wt%.

Mg, Si, Mn, Cr, Zr, V and Ti are not essential constituents but at least one of such elements other than Mg, i.e. a transition element, should be contained in the following ratios.

If the content of Mg exceeds 2.5 wt%, an elongation characteristic considerably lowers. Thus, the content is below 2.5 wt%.

If the content of Si is over 2.0 wt%, an elongation characteristic considerably lowers. Thus, the content is below 2.0 wt%.

The conftents of Mn, Cr, Zr and V are, respectively, less than 0.05 wt%, a fine crystal grain structure cannot be obtained for the reason described hereinbefore. When the contents of Mn, Cr, Zr and V are, respectively, over 0.5 wt% and the content of Ti is over 0.15 wt%, they are not satisfactorily dissolved upon casting, permitting gigantic intermetallic compounds to be produced. As a result, a satisfactory elongation cannot be achieved. Accordingly, the contents of Mn, Cr and Zr and V are, respectively, from 0.05 to 0.5 wt% and the content of Ti is below 0.15 wt%.

If Fe which may be obtained as an impurity is contained in amounts over 0.15 wt%, insoluble crystals are produced with a considerable lowering of elongation. Thus, the content of Fe should be below 0.15 wt%.

The superplastic aluminium alloys of the invention are more particularly described by way of examples.

EXAMPLE 1

An ingot (thickness: 400 mm) consisting of 5.7 wt% of Zn, 2.3 wt% of Mg, 1.5 wt% of Cu, 0.20 wt% of Cr, 0.10 wt% of Fe, 0.05 wt% of Si and the balance of Al was prepared according to an ordinary direct chill casting method (hereinafter referred to as "DC casting method"). The ingot was heated and homogenized at a temperature of 465° C. for 12 hours, followed by hot rolling at a temperature of 400° C. to obtain a 4–6 mm thick plate. Thereafter, the plate was processed under different conditions indicated in Table 1 to fabricate sheets with a final thickness of 2.5 mm, followed by heating at a temperature of 510° C. and deforming at a strain rate of $2\times10^{-4}$/second.

As will be apparent from the result of Table 1, the sheets made according to the present invention had 2 to about 6 times as high as the superplastic elongation of the comparative sheet obtained by a known method.

TABLE 1

| Sheet No. | Heating Conditions (°C. × hrs.) | Cooling Rate (°C./hr) | Cold Rolling (%) | Superplastic Elongation (%) | Grain Size (μm) $d_L$* | Grain Size (μm) $d_S$** |
|---|---|---|---|---|---|---|
| 1 | 510 × 3 + 400 × 10 | 100 | 40 | 490 | 15 | 9 |
| 2 | " | " | 60 | 580 | 11 | 8 |
| 3 | 510 × 2 + 450 × 10 | " | 60 | 480 | 15 | 9 |
| 4 | " | " | 80 | 520 | 13 | 9 |
| 5 | 510 × 3 + 400 × 10 | 40 | 60 | 350 | 26 | 10 |
| 6 | " | 20 | 60 | 270 | 33 | 11 |
| 7 | comparative alloy (prepared by an ordinary method) | | | 100 | 63 | 14 |

Note:
*$d_L$ Longitudinal grain size
**$d_S$ Short transverse grain size

EXAMPLE 2

Ingots having, respectively, compositions of 4.5 wt% of Cu, 1.5 wt% of Mg, 0.6 wt% of Mn, 0.10 wt% of Fe and the balance of Al (alloy 1) and 6.3 wt% of Cu, 0.3 wt% of Mn, 0.15 wt% of Zr, 0.10 wt% of V, 0.06 wt% of Ti and the balance of Al (alloy 2) were cast according to the ordinary DC casting method. Each ingot was heated and homogenized at a temperature of 490° C. for 12 hours and hot rolled at a temperature of 420° C. to obtain a 6.3 mm thick plate. The plate was subsequently heated and maintained at a temperature of 520° C. for 3 hours and then at a temperature of 450° C. for 12 hours, followed by cooling at a rate of about 100° C./hour and cold rolling to fabricate a 2.5 mm thick sheet (cold working rate: 60%). The sheet was deformed at 475° C. at a strain rate of $1\times10^{-3}$/second.

As will be seen from Table 2, the alloy sheets made according to the invention had 2 times or higher the superplastic elongation of the sheets obtained by a known method.

TABLE 2

| Alloy No. | Sheet of Invention: Grain Size (μm) $d_L$ | Sheet of Invention: Grain Size (μm) $d_S$ | Sheet of Invention: Superplastic (%) | Prior-art Sheet: Grain Size (μm) $d_L$ | Prior-art Sheet: Grain Size (μm) $d_S$ | Prior-art Sheet: Superplastic (%) |
|---|---|---|---|---|---|---|
| 1 | 18 | 10 | 340 | 59 | 21 | 150 |
| 2 | 15 | 10 | 360 | 49 | 18 | 180 |

EXAMPLE 3

An ingot (thickness 400 mm) of the same type as obtained in Example 1 according to the known DC casting method was heated and homogenized at a temperature of 465° C. for 12 hours, followed by hot rolling at a temperature of 400° C. to obtain a 6.3 mm thick plate.. The plate was heated and maintained at a temperature of 510° C. for 3 hours and then at a temperature of 400° C. for 10 hours, followed by cooling at a rate of about 100° C./hour and cold rolling to obtain a 2.5 mm thick sheet. The sheet was heated and softened to a temperature of 480° C. at different heating rates indicated in Table 3 and deformed at a temperature of 510° C. at a strain rate of $2\times10^{-4}$/second.

As will be seen from Table 3, the sheets which were softened at heating rates over 100° C./hour, inclusive, according to the present invention are much superior to the sheet obtained at a heating rate of 40° C./hour.

TABLE 3

| Alloy No. | Heating Rate (°/Hour) | Superplastic Elongation (%) | Grain Size $d_L$ (μm) | Grain Size $d_S$ (μm) |
|---|---|---|---|---|
| 1 | 1500 | 620 | 10 | 8 |
| 2 | 100 | 520 | 13 | 9 |
| 3 | 40 | 160 | 60 | 14 |

EXAMPLE 4

The alloy No. 2 (thickness 400 mm) of Example 2 obtained by casting according to the ordinary DC casting method was homogenized at a temperature of 490°

C. for 12 hours and hot rolled at a temperature of 420° C. to obtain a 6.3 mm thick plate. The plate was heated and kept at a temperature of 520° C. for 3 hours and then at 450° C. for 10 hours, followed by cooling at a rate of about 100° C./hour and cold rolling into a 2.5 mm thick sheet. The sheet was thermally softened at different heating rates indicated in Table 4 and deformed at a temperature of 475° C. at a strain speed of $1\times10^{-3}$/second. The results are shown in Table 4 below.

TABLE 4

| No. | Heating Rate (°C./Hr.) | Superplastic Elongation (%) | Grain Size (μm) $d_L$ | $d_S$ |
|---|---|---|---|---|
| 1 | 1500 | 370 | 15 | 9 |
| 2 | 100 | 350 | 17 | 10 |
| 3 | 40 | 190 | 46 | 18 |

The alloy No. 3 which is for comparison is below about a half the alloy Nos. 1 and 2 of the invention, which are processes at heating rates of 100° C./hour or higher, with respect to the superplastic elongation.

EXAMPLE 5

An ingot (thickness 400 mm) of the same type as produced in Example 1 by the ordinary DC casting method was heated and homogenized at a temperature of 465° C. for 12 hours and hot rolled at a temperature of 400° C. to obtain a 12.5 mm thick plate. The plate was kept at a temperature of 510° C. for 3 hours and then at 400° C. for 10 hours, followed by cooling at a rate of about 100° C./hr and cold rolling and annealing at low temperatures under different conditions indicated in Table 5 to make 2.5 mm thick sheets. Thereafter, each sheet was heated to a temperature of 510° C. and deformed at a strain speed of $2\times10^{-4}$/second.

As will be apparent from the results of Table 5, the superplastic aluminium alloys according to the present invention had superplastic elongations equal to or higher than the sheet undergoing no softening and annealing at low temperatures.

TABLE 5

| No. | Cold Rolling (%) | Low Temperature Softening and Annealing (°C. × Hour) | Cold Rolling (%) | Grain Size (μm) $d_L$ | $d_S$ | Superplastic Elongation (%) |
|---|---|---|---|---|---|---|
| 1 | 40 | 100 × 2 | 40 | 13 | 9 | 530 |
| 2 | " | 200 × 2 | " | 11 | 8 | 580 |
| 3 | " | 250 × 2 | " | 15 | 9 | 480 |
| 4 | " | 350 × 2 | " | 31 | 11 | 330 |
| 5 | " | nil | " | 17 | 9 | 450 |

EXAMPLE 6

The alloy No. 2 (thickness 400 mm) of Example 2 produced by the ordinary DC casting method was heated and homogenized at a temperature of 490° C. for 12 hours and hot rolled at a temperature 420° C. to make a 12.5 mm thick plate. The plate was kept at a temperature of 520° C. for 3 hours and then at a temperature of 450° C. for 10 hours, followed by cooling at a rate of about 100° C. and cold rolling, low temperature softening and annealing under different conditions indicated in Table 6 to obtain 2.5 mm thick sheets. Each sheet was heated to 475° C. and deformed at a strain speed of $1\times10^{-3}$/second. The sheet obtained according to the invention had much superior in superplastic elongation to the sheet for comparison where no low temperature softening and annealing was effected.

TABLE 6

| No. | Cold Rolling (%) | Low Temperature Softening and Annealing (°C. × Hour) | Cold Rolling (%) | Grain Size (μm) $d_L$ | $d_S$ | Superplastic Elongation (%) |
|---|---|---|---|---|---|---|
| 1 | 40 | 200 × 2 | 40 | 16 | 10 | 360 |
| 2 | " | nil | " | 18 | 10 | 340 |

What is claimed is:

1. A sheet of superplastic aluminum alloy exhibiting a superplastic elongation of 480% or higher selected from the group consisting of Al—Zn—Mg alloys and Al—cu alloys and having a maximum grain size below 30 μm on average which are obtained by a method which comprises the steps of:
   (1) homogenizing a high strength aluminum alloy ingot comprising at least one solute element and at least one transition element under heating conditions;
   (2) subjecting the alloy ingot to hot working to form an alloy plate;
   (3) heating the alloy plate to a first temperature higher than a solution temperature of the at least one solute element and keeping it at the first temperature;
   (4) cooling the alloy plate to a temperature at which the at least one solute metal element is precipitated and then keeping the alloy plate at the precipitating temperature for a time sufficient to cause fine intermetallic compounds of the at least one transition element and aluminum to precipitate uniformly;
   (5) cooling the alloy plate at such a rate of cooling of 100° C./hour or higher to result in precipitates being obtained of the intermetallic compounds of the at least one solute element of a size finer than those obtained at a slower cooling rate; and
   (6) subjecting the cooled alloy plate to cold working to the extent of 60 to 80%, to thereby achieve the above stated superplastic elongation property and grain size.

2. The aluminium alloy sheet according to claim 1, wherein the sheet is further softened after the cold working step (6).

3. The aluminium alloy sheet according to claim 2, wherein, after the cold working, the sheet is further softened at low temperature and again cold worked.

4. The aluminium alloy sheet according to claim 1, wherein the Al—Zn—Mg alloy has a composition which comprises 3 to 8 wt% of Zn, 0.5 to 3 wt% of Mg, at least one transition element selected from the group consisting of 0.05 to 2.0 wt% of Mn, 0.05 to 0.5 wt% of Cr, 0.05 to 0.5 wt% of Zr, 0.05 to 0.5 wt% of V and below 0.15 wt% of Ti, and the balance of Al and inevitable impurities.

5. The aluminium alloy sheet according to claim 4, further comprising below 3 wt% of Cu.

6. The aluminium alloy sheet according to claim 1, wherein the Al—Cu alloy has a composition which comprises 2 to 7 wt% of Cu, at least one transition element selected from the group consisting of 0.05 to 0.5 wt% of Mn, 0.05 to 0.5 wt% of Cr, 0.05 to 0.5 wt% of Zr, 0.05 to 0.5 wt% of V and below 0.15 wt% of Ti, and the balance of Al and inevitable impurities.

7. The aluminium alloy sheet according to claim 6, further comprising at least one member selected from the group consisting of below 2.5 wt% of Mg and below 2.0 wt% of Si.

8. A sheet of superplastic aluminum alloy exhibiting a superplastic elongation of 480% or higher selected from the group consisting of Al—Zn—Mg alloys and Al—Cu alloys and having a maximum grain size below 30 μm on average which are obtained by a method which comprises the steps of:

(1) homogenizing a high strength aluminum alloy ingot comprising at least one solute element and at least one transition element at a temperature of 400° to 550° C.;

(2) subjecting the alloy ingot to hot working at a temperature of 350° to 500° C. to form an alloy plate;

(3) heating the alloy plate within a first temperature of 450° C. to 550° C. which is higher than the solution temperature of the at least one solute element and keeping it at the first temperature for a time of 0.5 to 10 hours;

(4) cooling the alloy plate down to a second temperature of 350° to 450° C. and then keeping the alloy plate at the second temperature for a time of 0.5 to 50 hours at which temperature the at least one solute metal element is precipitated and which time is selected to be sufficient to cause fine intermetallic compounds of at least one transition element and aluminium to precipitate uniformly;

(5) cooling the alloy plate at such a rate of 100° C./hour or higher to result in precipitates being obtained of the intermetallic compounds of the at least one solute element of a size finer than those obtained at a slower cooling rate; and (6) subjecting the cooled alloy plate to cold working to an extent of 60% to 80%, to thereby achieve the above stated superplastic elongation property and grain size.

9. The aluminium alloy sheet according to claim 8, wherein the cold worked alloy sheet is further softened by heating to a temperature between 350° to 550° C. at a heating rate of not lower than 100° C./hour.

10. The aluminium alloy sheet according to claim 8, wherein the cold worked sheet of step (6) is further cold worked to 20 to 60%, softened at a temperature lower than 300° C. and again cold processed.

11. The aluminium alloy sheet according to claim 10, wherein the alloy sheet is further softened at a temperature between 350° and 550° C. at a heating rate of not lower than 100° C./hour.

12. The aluminium alloy sheet according to claim 8, wherein the Al—Zn—Mg alloy has a composition which comprises 3 to 8 wt% of Zn, 0.5 to 3 wt% of Mg, at least one transition element selected from the group consisting of 0.05 to 2.0 wt% of Mn, 0.05 to 0.5 wt% of Cr, 0.05 to 0.5 wt% of Zr, 0.05 to 0.5 wt% of V and below 0.15 wt% of Ti, and the balance of Al and inevitable impurities.

13. The aluminium alloy sheet according to claim 12, further comprising below 3 wt% of Cu.

14. The aluminium alloy sheet according to claim 8, wherein the Al—Cu alloy has a composition which comprises 2 to 7 wt% of Cu, at least one transition element selected from the group consisting of 0.05 to 0.5 wt% of Mn, 0.05 to 0.5 wt% of Cr, 0.05 to 0.5 wt% of Zr, 0.05 to 0.5 wt% of V and below 0.15 wt% of Ti, and the balance of Al and inevitable impurities.

15. The aluminium alloy sheet according to claim 14, further comprising at least one member selected from the group consisting of below 2.5 wt% of Mg and below 2.0 wt% of Si.

* * * * *